US010543587B2

(12) United States Patent
Chiang

(10) Patent No.: US 10,543,587 B2
(45) Date of Patent: Jan. 28, 2020

(54) SOCKET WRENCH

(71) Applicant: SHIN YING ENTPR CO., LTD., Taichung (TW)

(72) Inventor: Wen-Hung Chiang, Taichung (TW)

(73) Assignee: SHIN YING ENTPR CO., LTD., Taichung (TW)

( * ) Notice: Subject to any disclaimer, the term of this patent is extended or adjusted under 35 U.S.C. 154(b) by 185 days.

(21) Appl. No.: 15/890,821

(22) Filed: Feb. 7, 2018

(65) Prior Publication Data

US 2019/0240817 A1 Aug. 8, 2019

(51) Int. Cl.
*B25B 23/00* (2006.01)
*B25B 21/00* (2006.01)

(52) U.S. Cl.
CPC ..... *B25B 23/0035* (2013.01); *B25B 21/00* (2013.01); *B25B 23/0057* (2013.01)

(58) Field of Classification Search
CPC ..... B25B 23/0035; B25B 23/0057; B25B 23/0042; B25B 21/00; B25B 13/06
See application file for complete search history.

(56) References Cited

U.S. PATENT DOCUMENTS 7,452,006 B2 * 11/2008 Kohda ..... F16L 37/23 285/276
9,884,413 B2 * 2/2018 Patterson ..... B25B 23/0021
2009/0151520 A1 * 6/2009 Wang ..... B25B 13/06 81/125
2019/0152029 A1 * 5/2019 Chiang ..... B25B 23/0035

* cited by examiner

*Primary Examiner* — David B. Thomas
(74) *Attorney, Agent, or Firm* — Muncy, Geissler, Olds & Lowe, P.C.

(57) ABSTRACT

The present invention provides a socket wrench, including a main body and a control sleeve. The main body includes a socket end and a connection end. The socket end is configured to be connected with a fastener. The connection end is configured to be connected with the insertion portion. The connection end includes at least one first through hole. At least one positioning member is movably restricted within the at least one first through hole. The control sleeve is movably assembled to the connection end. The control sleeve includes a first portion and a second portion. The first portion has at least one receiving hole which is selectively correspondable to the at least one first through hole. The first portion is inserted into the second portion. The at least one receiving hole is disposed inside the second portion.

9 Claims, 8 Drawing Sheets

SOCKET WRENCH

BACKGROUND OF THE INVENTION

Field of the Invention

The present invention relates to a socket wrench.

Description of the Prior Art

A socket wrench is one of the most commonly used tools in the mechanical processing factory. The socket wrench is used to drive a fastener (such as screw, bolt, and nut) to rotate, and the socket wrench is usually operated with a driving tool, for instance combined with a wrench to produce a greater torque to drive the fastener, or combined with a pneumatic/electrical tool to reduce physical exertion.

One of the conventional combinations of the socket wrench and the driving tool is that positioning balls of an insertion portion of the driving tool would be connected with an inner surface of the socket wrench in tight fit way. However, the positioning balls and the inner surface are apt to be abraded so that the socket wrench has a risk of losing and throwing out of the driving tool in a long-term use. Another type of combination is that the insertion portion of the driving tool is a through hole. The socket wrench is assembled to the insertion portion, and a pin is inserted through the through hole to connect the socket wrench and the insertion portion. However, it may be inconvenient that the pin easily lost because there is no precaution on the socket wrench.

The present invention is, therefore, arisen to obviate or at least mitigate the above-mentioned disadvantages.

SUMMARY OF THE INVENTION

The main object of the present invention is to provide a socket wrench, which controls the positioning member to protrude within or leave the positioning openings of the insertion portion of the driving tool through the control sleeve located at different positions, so as to reduce abrasion. In addition, the control sleeve is made by two-piece assembly to make it easier to manufacture.

To achieve the above and other objects, the present invention provides a socket wrench, including a main body and a control sleeve. The main body includes a socket end and a connection end. The socket end is configured to be connected with a fastener. The connection end is configured to be connected with the insertion portion. The connection end includes at least one first through hole. At least one positioning member is movably restricted within the at least one first through hole. The control sleeve is movably assembled to the connection end. The control sleeve includes a first portion and a second portion. The first portion has at least one receiving hole which is selectively correspondable to the at least one first through hole. The first portion is inserted into the second portion. The at least one receiving hole is disposed inside the second portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
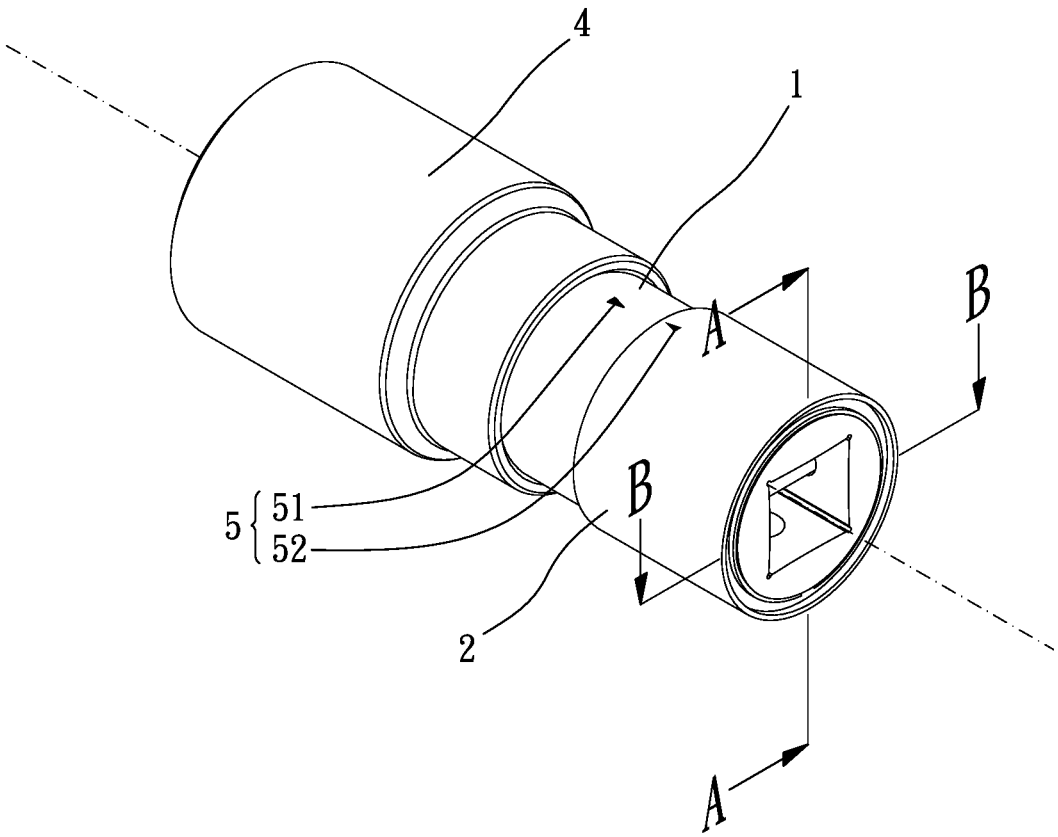
FIG. 1 is a stereogram of a preferable embodiment of the present invention.
Figure 2:
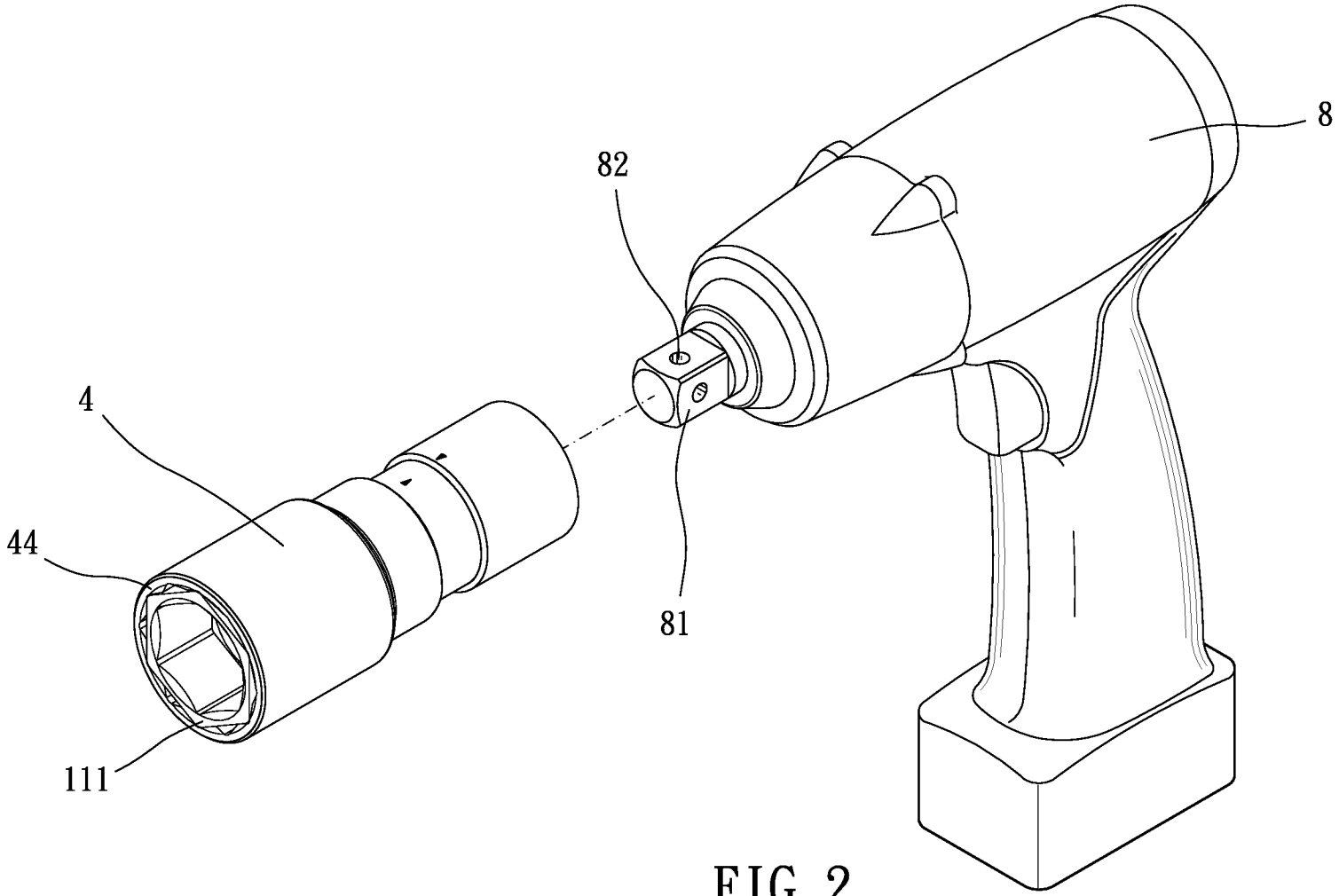
FIG. 2 is an assembly schematic diagram when a socket wrench is assembled to a driving tool.
Figure 3:
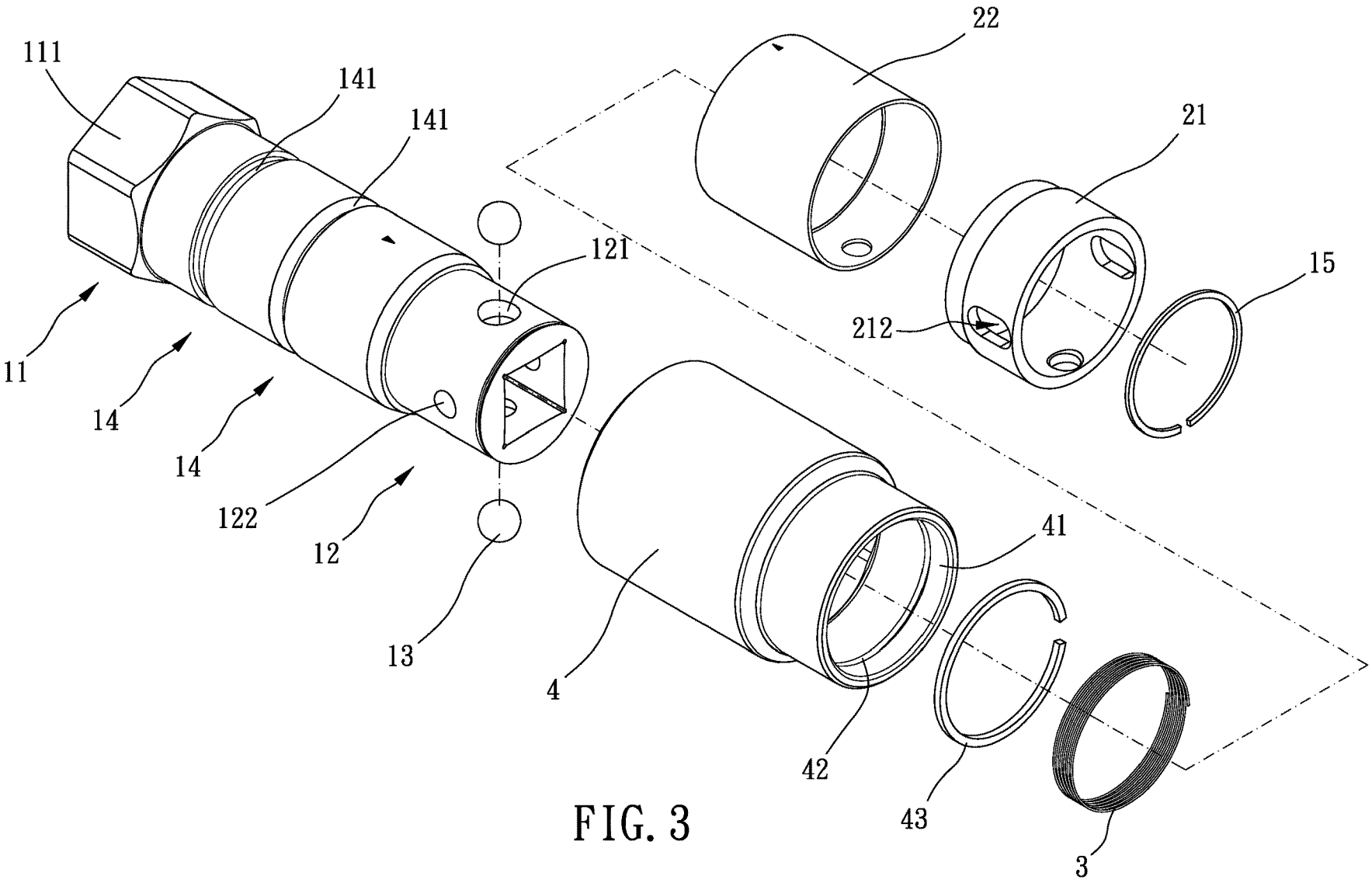
FIG. 3 is a breakdown drawing of FIG. 1.
Figure 4:
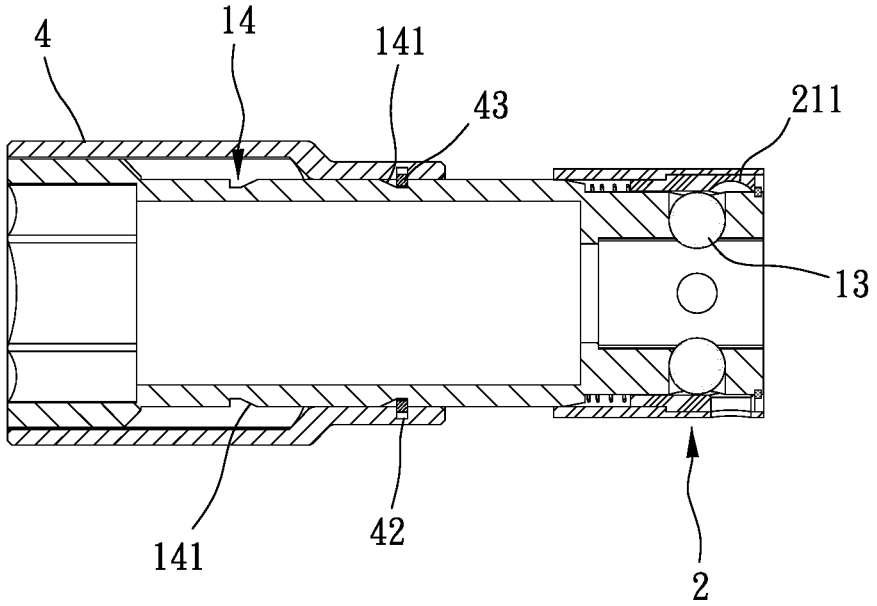
FIG. 4 is a cross-sectional view of the A-A end surface of a control sleeve in FIG. 1 at a locked position.
Figure 5:
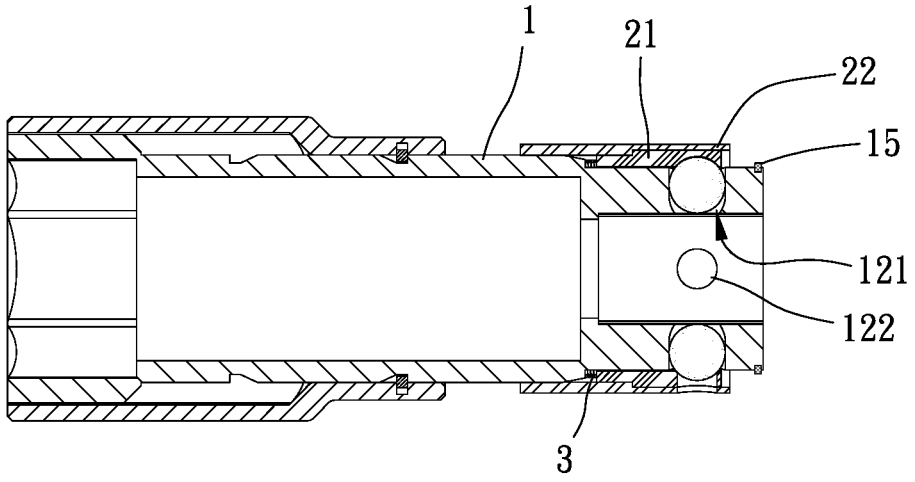
FIG. 5 is a cross-sectional view of the A-A end surface of a control sleeve in FIG. 1 at a release position.
Figure 6:
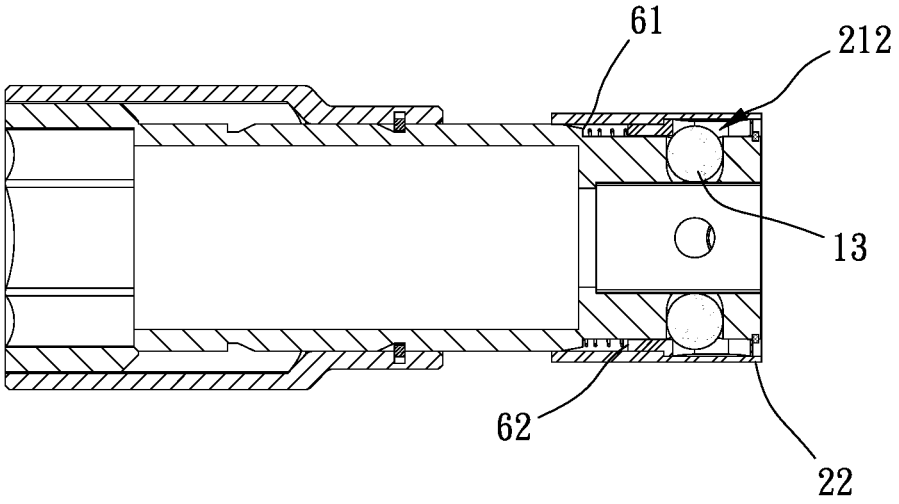
FIG. 6 is a cross-sectional view of the A-A end surface of a control sleeve in FIG. 1 at a covering position.
Figure 7:
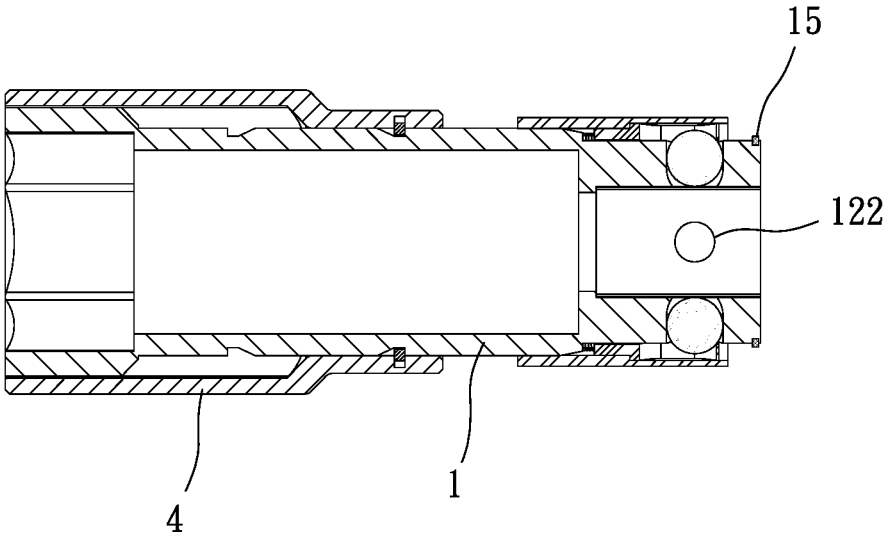
FIG. 7 is a cross-sectional view of the A-A end surface of a control sleeve in FIG. 1 at an assembly position.
Figure 8:
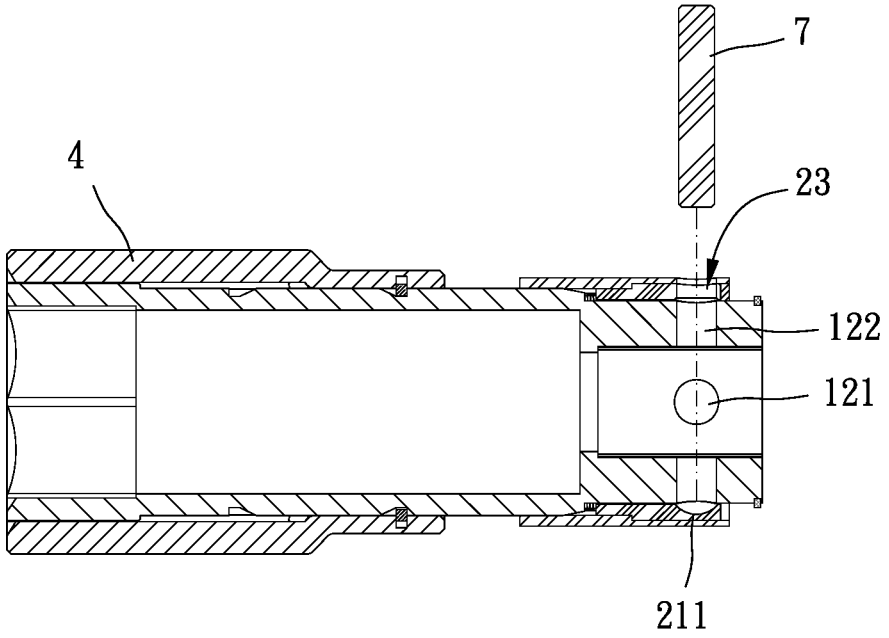
FIG. 8 is an assembly diagram of a pin of the B-B end surface in FIG. 1.
Figure 9:
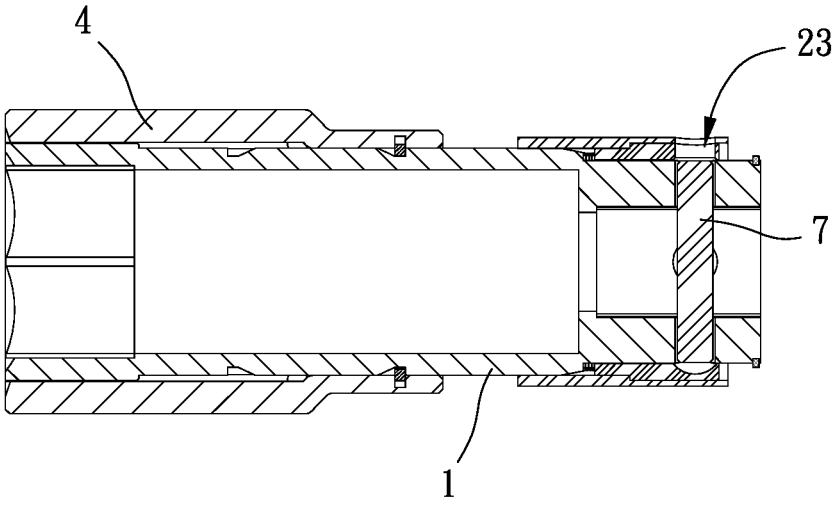
FIG. 9 is a cross-sectional view of the B-B end surface of a control sleeve in FIG. 1 at an assembly position.
Figure 10:
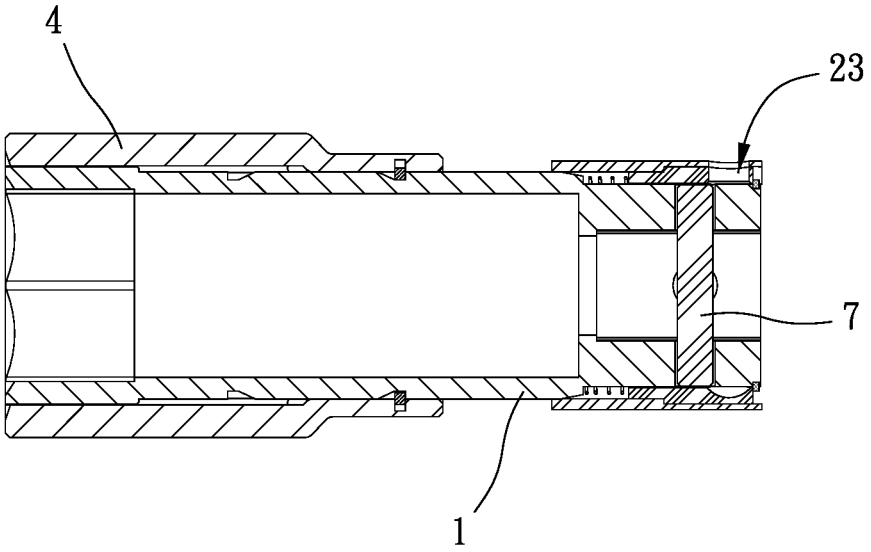
FIG. 10 is a cross-sectional view of the B-B end surface of a control sleeve in FIG. 1 at a covering position.
Figure 12:
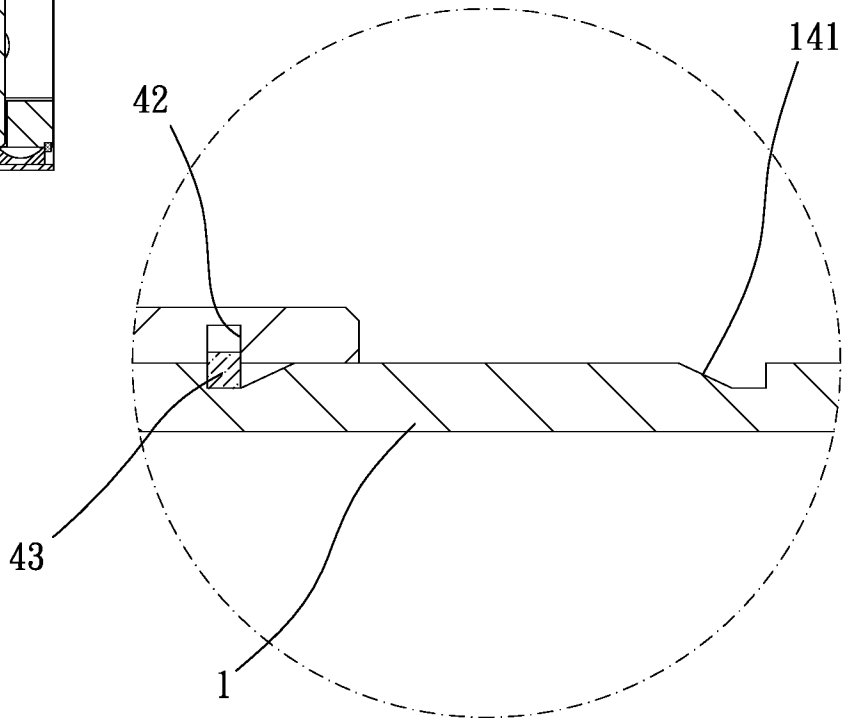
FIG. 12 is a partial enlargement of FIG. 11.
Figure 11:
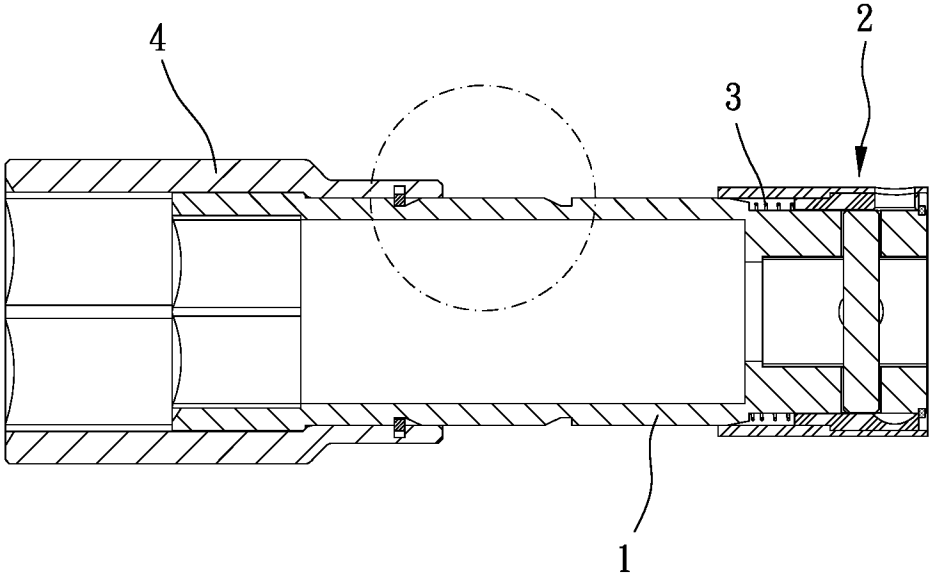
FIG. 11 is a cross-sectional view of the B-B end surface in FIG. 1 when the slidable sleeve protrudes beyond the socket end.

Please refer to FIGS. 1 to 12 for a preferable embodiment of the socket wrench, adapted for an insertion portion 81 of a driving tool 8, the insertion portion 81 having a plurality of position openings 82, the socket wrench including: a main body 1 and a control sleeve 2.

The main body 1 includes a socket end 11 and a connection end 12, the socket end 11 configured to be connected with a fastener, the connection end 12 configured to assemble to the insertion portion 81, the connection end 12 having at least one first through hole 121, at least one positioning member 13 being movably restricted within the at least one first through hole 121, and the positioning member 13 being partially protrudable out of the at least one first through hole 121, in this embodiment, two of the positioning members 13 are rolling balls for moving smoothly. The connection end 12 is smaller than the socket end 11 in radial dimension.

The control sleeve 2 is movably assembled to the connection end 12, the control sleeve 2 including a first portion 21 and a second portion 22, the first portion 21 having at least one receiving hole 211 which is selectively correspondable to the at least one first through hole 121, the first portion 21 being inserted into the second portion 22, the at least one receiving hole 211 being disposed inside the second portion 22.

When the control sleeve 2 is in a locked position, each of the receiving hole 211 and each of the first through hole 121 are misaligned with each other, the first portion 21 presses each of the at least one positioning member 13 to protrude out of one of the at least one first through hole 121 and into one of the position openings 82 so that the main body 1 is positioned at the insertion portion 81. When the control sleeve 2 is in a release position, the at least one receiving hole 211 corresponds to the at least one first through hole 121, the first portion 21 do not press each of the positioning members 13, each of the positioning members 13 is retractable into one of the at least one receiving hole 211 and disengageable from one of the position openings 82, as a result, the main body 1 disattached smoothly from the insertion portion 81. According to the method described above, abrasion between the positioning member 13 and the insertion portion 81 is preventable and has a longer lifetime.

A blocking member 15 is positioned at a top of the connection end 12 to restrict the control sleeve 2 to move in a specific range, so as to prevent the control sleeve 2 to depart from the connection end 12. The control sleeve 2 is divided into two different components, the first portion 21 and the second portion 22, to make it easier for processing the first portion 21 individually. Moreover, the second portion 22 covers the whole first portion 21 so that the control sleeve 2 has a better appearance.

In this embodiment, it is contributive to rapid assembly that the first portion 21 and the second portion 22 are connected in tight fit way to combine into the control sleeve 2. In addition, the second portion 22 protrudes beyond the first portion 21 in the axial direction of the main body 1, the second portion 22 covers the blocking member 15 when the control sleeve 2 is in the locked position, so as to avoid the blocking member 15 from collision and to make the blocking member 15 stably positioned on the connection end 12.

The socket wrench further includes an elastic member 3, the elastic member 3 disposed between the control sleeve 2 and the main body 1 so that the control sleeve 2 has a tendency to move toward the locked position. Once the operator does not apply forces to the control sleeve 2, the elastic member 3 will push the control sleeve 2 to the locked position immediately for automatic locking and better support to the control sleeve 2. Thus, it is safer that the control sleeve 2 may not be easily moved due to unexpected forces.

In this embodiment, the main body 1 has a first stepped portion 61 at the connection end 12, and a second stepped portion 62 is formed between the first portion 21 and the second portion 22, the elastic member 3 being sleeved onto the main body 1, two ends of the elastic member 3 about against the first stepped portion 61 and the second stepped portion 62 respectively. Moreover, the second portion 22 keeps covering the elastic member 3, the first stepped portion 61 and the second stepped portion 62 regardless of the position of the control sleeve 2 to ensure that the operation of the elastic member 3 may not be affected.

Preferably, the control sleeve 2 is disposed on the main body 1 and movable along an axial direction of the main body 1 rotatable around the main body 1. Relatively misaligned conditions of the at least one receiving hole 211 and the at least one first through hole 121 are largely increased by operation in two directions, so as to prevent the control sleeve 2 from moving to the release position accidentally due to unexpected factors, making the combination of the socket wrench and the insertion portion 81 firmer.

The socket wrench further includes an alignment unit 5, the alignment unit 5 including a first index portion 51 and a second index portion 52, the first index portion 51 disposed on the main body 1 and aligned with one of the at least one first through hole 121 in the axial direction of the main body 1, and the second index portion 52 is disposed on the control sleeve 2 and aligned with one of the at least one receiving hole 211 in the axial direction of the main body 1. The operator is able to know the relatively positions of the two receiving holes 211 and the two first through holes 121 by the alignment unit 5.

Another type of combination between the socket wrench and the insertion portion 81 is provided. In this embodiment, the at least one first through hole 121, the at least one positioning member 13 and the at least one receiving hole 211 are two, when two of the position openings 82 of the insertion portion 81 are communicated, the connection end 12 further includes two second through holes 122 which face each other, the two second through holes 122 configured to correspond to the two position openings 82. The control sleeve 2 further has an insertion hole 23 disposed therethrough, the first portion 21 further including two grooves 212 which face each other and extend along the axial direction of the main body 1, the two positioning members 13 being selectively and slidably disposed partially within the two grooves 212.

When the control sleeve 2 is in an assembly position, the two positioning members 13 are partially within the two grooves 212 and nonprotrusive to engage with the insertion portion 81, the insertion hole 23 corresponding to the two second through holes 122 so as to allow a pin 7 pass therethrough to connect the connection end 12 and the insertion portion 81. When the control sleeve 2 is moved along with the axial direction of the main body 1 to a covering position, the two positioning members 13 are partially within the two grooves 212 and nonprotrusive to engage with the insertion portion 81, the insertion hole 23 misaligned with the two second through holes 122, and the control sleeve 2 covers the two second through holes 122, the pin 7 is restricted by the control sleeve 2 to prevent from falling during use.

The two grooves 212 are configured to prevent the two positioning members 13 from pressing by the control sleeve 2. When the control sleeve 2 moves between the assembly position and the covering position, the insertion portion 81 is able to smoothly insert into the connection end 12. In this embodiment, a connecting line of the two first through holes 121 is perpendicular to a connecting line of the two second through holes 122, a connecting line of the two grooves 212 is perpendicular to a connecting line of the two receiving holes 211. Wherein, one of the receiving holes 211 is formed as a part of the insertion hole 23 to simplify the structure and ease of processing.

In another embodiment, the insertion portion 81 has the position openings 82 on each of four sides. After inserting the pin 7 to connect the connection end 12 and the insertion portion 81, the operator can further rotate the control sleeve 2 to make the first portion 21 press the two positioning members 13 and insert into the other two of the position openings 82 so that the main body 1 is position at two directions which are perpendicular to each other.

The main body 1 has a first driving portion 111 with a polygonal contour at the socket end 11, the first driving portion 111 configured to assemble to the fastener in order to drive the fastener to rotate. The socket wrench further includes a slidable sleeve 4, the slidable sleeve 4 is disposed on the main body 1 and slidably beyond the socket end 11, the slidable sleeve 4 has a second driving portion 44 with a polygonal contour, the second driving portion 44 is configured to assemble to another fastener; the first driving portion 111 is smaller than the second driving portion 44 in radial dimension. Therefore, the socket wrench may be suitable for two different sizes of the fasteners and has an advantage of space-saving.

In this embodiment, the contour of the first driving portion 111 is a hexagon, the contour of the second driving portion 44 is a dodecagon, and the first driving portion 111 is less than the second driving portion 44 in the number of corners.

The main body 1 has two positioning grooves 14 between the socket end 11 and the connection end 12, an inner surface 41 of the slidable sleeve 4 having an engagement portion 43, the engagement portion 43 being selectively engageable within one of the positioning grooves 14 to achieve the purpose of positioning the slidable sleeve 4. Wherein, the two position groove 14 preferably each have a guide inclined face 141 on adjacent sides of the two positioning grooves respectively, the guide inclined faces 141 of the two positioning grooves extend toward the inner surface 41 and obliquely closed to each other, the guide inclined faces 141 are configured to guide the engagement portion 43 to engage within or disengage from one of the positioning grooves 14.

A maximum depth of each of the positioning grooves 14 is identical and is 0.3 to 0.5 times a thickness of the main body 1 between 0.3 and 0.5, a ratio of a minimum distance between the two guide inclined faces 141 to a length of the main body In the axial direction of the main body 1 is ranged between 0.13 and 0.18. A slope of each of the guide inclined faces is ranged between 0.4 and 0.5. The engagement portion 43 is a C-shaped buckle, the inner surface 41 of the slidable sleeve 4 having a receiving groove 42, the engagement portion 43 movably engaged in the receiving groove 42.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A socket wrench, adapted for an insertion portion of a driving tool, the insertion portion having a plurality of position openings, the socket wrench including:

a main body, including a socket end and a connection end, the socket end configured to be connected with a fastener, the connection end configured to assemble to the insertion portion, the connection end having at least one first through hole, at least one positioning member being movably restricted within the at least one first through hole, and the at least one positioning member being partially protrudable out of the at least one first through hole;

a control sleeve, movably assembled to the connection end and including a first portion and a second portion, the first portion having at least one receiving hole which is selectively correspondable to the at least one first through hole, the first portion being inserted into the second portion, the at least one receiving hole being disposed inside the second portion;

wherein when the control sleeve is in a locked position, each of the at least one receiving hole and each of the at least one first through hole are misaligned with each other, the first portion presses each of the at least one positioning member to protrude out of one of the at least one first through hole and into one of the position openings so that the main body is positioned at the insertion portion; when the control sleeve is in a release position, the at least one receiving hole corresponds to the at least one first through hole, the first portion do not press each of the positioning members, each of the at least one positioning members is retractable into one of the at least one receiving hole and disengageable from one of the position openings.

2. The socket wrench of claim 1, wherein the control sleeve is disposed on the main body and movable along an axial direction of the main body and rotatable around the main body.

3. The socket wrench of claim 2, wherein two of the position openings of the insertion portion are communicated, respective numbers of the at least one first through hole, the at least one positioning member and the at least one receiving hole are two, the connection end further includes two second through holes which face each other, the two second through holes are configured to correspond to the two position openings, the control sleeve further has an insertion hole disposed therethrough, the first portion further includes two grooves which face each other and extend along the axial direction of the main body, the two positioning members are selectively and slidably disposed partially within the two grooves; when the control sleeve is in an assembly position, the two positioning members are partially within the two grooves and nonprotrusive to engage with the insertion portion, the insertion hole corresponds to the two second through holes so as to allow a pin to pass therethrough to connect the connection end and the insertion portion; when the control sleeve is moved along with the axial direction of the main body to a covering position, the two positioning members are partially within the two grooves and nonprotrusive to engage with the insertion portion, the insertion hole is misaligned with the two second through holes, and the control sleeve covers the two second through holes.

4. The socket wrench of claim 3, wherein a connecting line of the two first through holes is perpendicular to a connecting line of the two second through holes, a connecting line of the two grooves is perpendicular to a connecting line of the two receiving holes, and one of the receiving holes is formed as a part of the insertion hole.

5. The socket wrench of claim 4, wherein further including an elastic member, the elastic member disposed between the control sleeve and the main body so that the control sleeve has a tendency to move toward the locked position; the main body has a first driving portion with a polygonal contour at the socket end, the first driving portion is configured to assemble with the fastener, the socket wrench further includes a slidable sleeve, the slidable sleeve is disposed on the main body and slidably beyond the socket end, the slidable sleeve has a second driving portion with a polygonal contour, the second driving portion is configured to assemble with another fastener; the first driving portion is smaller than the second driving portion in radial dimension; the first driving portion has less corners than the second driving portion has; the main body further has two positioning grooves between the socket end and the connection end, an inner surface of the slidable sleeve has an engagement portion, the engagement portion is selectively engageable within one of the positioning grooves; the two positioning grooves each have a guide inclined face on adjacent sides of the two positioning grooves respectively, the guide inclined faces of the two positioning grooves extend toward the inner surface and obliquely closed to each other, and the guide inclined faces are configured to guide the engagement portion to engage within or disengage from one of the positioning grooves; the socket wrench further including an alignment unit, the alignment unit including a first index portion and a second index portion, wherein the first index portion is disposed on the main body and aligned with one of the at least one first through hole in an axial direction of the main body, and the second index portion is disposed on the control sleeve and aligned with one of the at least one receiving hole in the axial direction of the main body; the contour of the first driving portion is a hexagon, the contour of the second driving portion is a dodecagon; the inner surface of the slidable sleeve has a receiving groove, the engagement portion is movably engaged in the receiving groove; the engagement portion is a C-shaped buckle; the connection end is smaller than the socket end in radial dimension; the main body has a first stepped portion at the connection end, and a second stepped portion is formed between the first portion and the second portion, the elastic member is sleeved onto the main body, two ends of the elastic member abut against the first stepped portion and the second stepped portion respectively; the first portion and the second portion are connected in tight fit way; a blocking member is positioned at a top of the connection end, the second portion protrudes beyond the first portion in the axial direction of the main body, the second portion covers the blocking member when the control sleeve is in the locked position; the second portion keeps covering the elastic member, the first stepped portion and the second stepped portion regardless of the position of the control sleeve; a ratio of a minimum distance between the two guide inclined faces to a length of the main body in the axial direction of the main body is ranged between 0.13 and 0.18; a slope of each of the guide inclined faces is ranged between 0.4 and 0.5; a maximum depth of each of the positioning grooves is identical and is 0.3 to 0.5 times a thickness of the main body; the two positioning members are rolling balls.

6. The socket wrench of claim 2, further including an elastic member, the elastic member disposed between the control sleeve and the main body so that the control sleeve has a tendency to move toward the locked position.

7. The socket wrench of claim 1, wherein the main body has a first driving portion with a polygonal contour at the socket end, the first driving portion is configured to assemble to the fastener, the socket wrench further includes a slidable sleeve, the slidable sleeve is disposed on the main body and slidably beyond the socket end, the slidable sleeve has a second driving portion with a polygonal contour, the second driving portion is configured to assemble to another fastener; the first driving portion is smaller than the second driving portion in radial dimension.

8. The socket wrench of claim 7, wherein the main body further has two positioning grooves between the socket end and the connection end, an inner surface of the slidable sleeve has an engagement portion, the engagement portion is selectively engageable within one of the positioning grooves; the two positioning grooves each have a guide inclined face on adjacent sides of the two positioning grooves respectively, the guide inclined faces of the two positioning grooves extend toward the inner surface and obliquely closed to each other, and the guide inclined faces are configured to guide the engagement portion to engage within or disengage from one of the positioning grooves.

9. The socket wrench of claim 1, further including an alignment unit, the alignment unit including a first index portion and a second index portion, wherein the first index portion is disposed on the main body and aligned with one of the at least one first through hole in an axial direction of the main body, and the second index portion is disposed on the control sleeve and aligned with one of the at least one receiving hole in the axial direction of the main body.

* * * * *